US005531449A

United States Patent [19]

Denton

[11] Patent Number: 5,531,449

[45] Date of Patent: Jul. 2, 1996

[54] PORTABLE STOOPBALL STRIKER

[76] Inventor: William H. Denton, 12 E. Augusta Ave., Staten Island, N.Y. 10308

[21] Appl. No.: 421,853

[22] Filed: Apr. 14, 1995

[51] Int. Cl.[6] ..... A63B 67/00

[52] U.S. Cl. ..... 273/348; 273/396; 273/88

[58] Field of Search ..... 273/396, 411, 273/342, 25, 26 R, 88, 398, 400, 401, 402, 348

[56] References Cited

U.S. PATENT DOCUMENTS

| | | | |
|---|---|---|---|
| 2,812,946 | 11/1957 | Hughes | 273/411 |
| 3,671,040 | 6/1972 | Meyer et al. | 273/342 X |
| 3,814,422 | 6/1974 | Girden | 273/30 |
| 4,133,531 | 1/1979 | Arteaga et al. | 273/102 R |
| 4,553,751 | 11/1985 | Ketchum | 273/26 A |
| 4,824,108 | 4/1989 | McLean | 273/30 |
| 5,332,230 | 7/1994 | Benedict | 273/402 X |
| 5,407,210 | 4/1995 | Canning | 273/396 X |

*Primary Examiner*—William H. Grieb
*Attorney, Agent, or Firm*—Richard L. Miller

[57] ABSTRACT

A portable stoop ball striker comprising a generally A-shaped framework, which may be either a rigid or folding embodiment having a rearward tilted front panel and a forward tilted rear panel. The framework can sit upon a horizontal playing field. The front panel has a striking face divided into a flat slopped upper surface, a horizontal edge and a curved lower surface. A person can throw a ball against the striking face to rebound the ball at different angles and speeds into the playing field, depending on the skill and strength of the person throwing the ball.

7 Claims, 2 Drawing Sheets

8

PORTABLE STOOPBALL STRIKER

BACKGROUND OF THE INVENTION

The instant invention relates generally to rebound ball game equipment and more specifically it relates to a portable stoop ball striker.

Numerous rebound ball game equipment have been provided in prior art that are adapted to bounce balls back towards players after the balls are tossed thereto. For example, U.S. Pat. No. 3,814,422 to Girden; U.S. Pat. No. 4,133,531 to Arteaga et al., U.S. Pat. No. 4,553,751 to Ketchum and U.S. Pat. No. 4,824,108 to McLean all are illustrative of such prior art. While these units may be suitable for the particular purpose to which they address, they would not be as suitable for the purposes of the present invention as heretofore described.

SUMMARY OF THE INVENTION

A primary object of the present invention is to provide a portable stoop ball striker that will overcome the shortcomings of the prior art devices.

Another object is to provide a portable stoop ball striker that is used by striking a rubber ball against its surface, thereby causing the ball to rebound at different angles and speeds depending on the skill and strength of the person throwing the ball.

An additional object is to provide a portable stoop ball striker, whereby its foremost advantage is its portability and size, allowing it to be used in backyards, sidewalks, parks, playgrounds, the street or at the beach.

A further object is to provide a portable stoop ball striker that is simple and easy to use.

A still further object is to provide a portable stoop ball striker that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
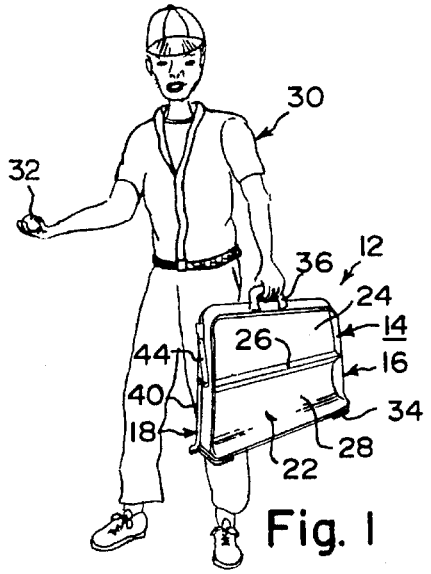
FIG. 1 is a diagrammatic perspective view illustrating a youngster carrying a folded first embodiment of the instant invention.
Figure 2:
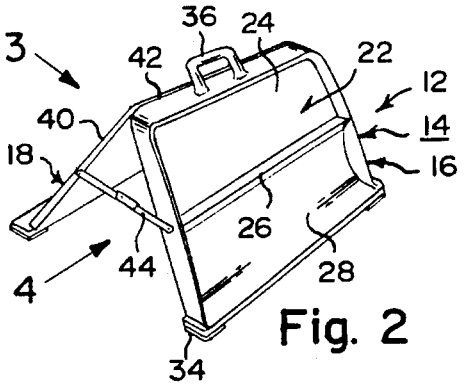
FIG. 2 is a diagrammatic perspective view thereof of the first embodiment of the instant invention unfolded and ready for use.
Figure 3:
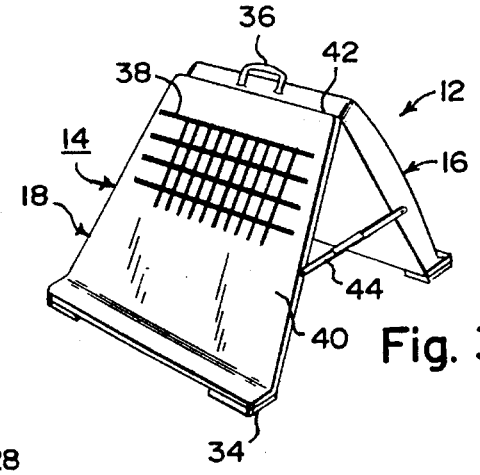
FIG. 3 is a diagrammatic perspective view taken generally in the direction of arrow 3 in FIG. 2.
Figure 4:
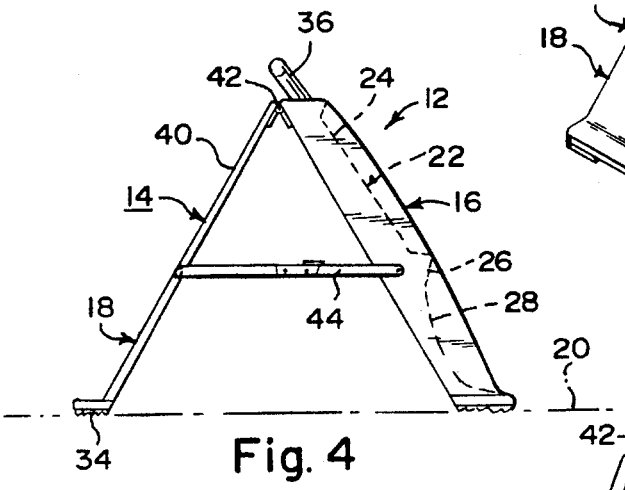
FIG. 4 is an enlarged side view taken in the direction of arrow 4 in FIG. 2.
Figure 5:
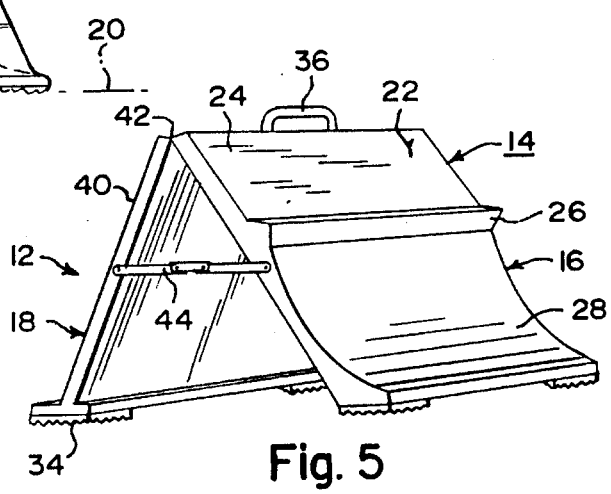
FIG. 5 is a diagrammatic perspective view similar to FIG. 2 of a second embodiment of the instant invention.
Figure 6:
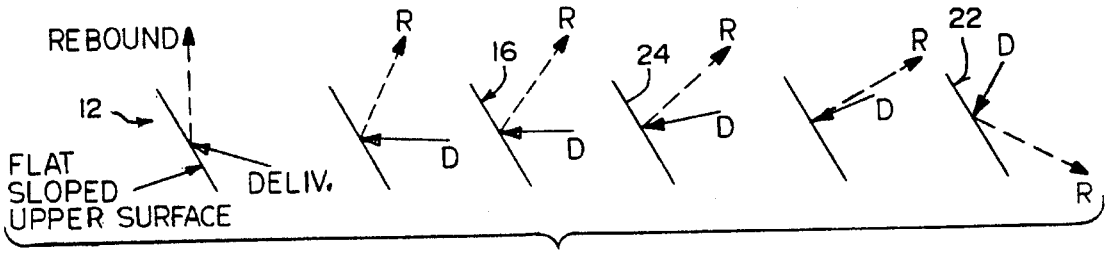
FIG. 6 is a diagrammatic side view illustrating how a ball rebounds off the flat sloped upper surface when delivered at various angles.

Turning now descriptively to the drawings, in which similar reference characters denote similar elements throughout the several views, FIGS. 1 through 10 illustrate a portable stoop ball striker 12, comprising a generally A-shaped framework 14 having a rearward tilted front panel 16 and a forward tilted rear panel 18. The framework 14 can sit upon a horizontal playing field 20. The front panel 16 has a striking face 22 divided into a flat slopped upper surface 24, a horizontal edge 26 and a curved lower surface 28. A person 30 can throw a ball 32 against the striking face 22 to rebound the ball 32 at different angles and speeds into said playing field 20, depending on the skill and strength of the person 30 throwing the ball 32.

Rubber foot pads 34 are secured to bottom edges of the front panel 16 and the rear panel 18. The foot pads 34 prevent the framework 14 from sliding upon the horizontal playing field 20, when the ball rebounds off of the striking face 22. A handle 36 is provided on a top edge of the framework 14, so that the person 30 can carry the framework 14 by the handle 36. A score board 38 is provided on an outer surface 40 of the rear panel 18, so that each player 30 can keep score on the score board 38.

As shown in FIGS. 1 through 5 and 8, the front panel 16 and the rear panel 18 of the framework 14 are separate attached cooperating parts. A hinge 42 rotatively connects the top edges of the front panel 16 and the rear panel 18. A pair of spreaders 44 are provided and each extends generally between central side edges of the front panel 16 and the rear panel 18. The framework 14 can be folded up with the front panel 16 against the rear panel 18, for easy carrying by the handle 36 and for better storage when not in use.

Figure 9:
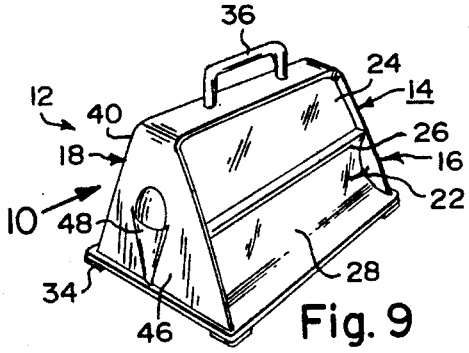
FIG. 9 is a diagrammatic perspective view of a third embodiment.
Figure 10:
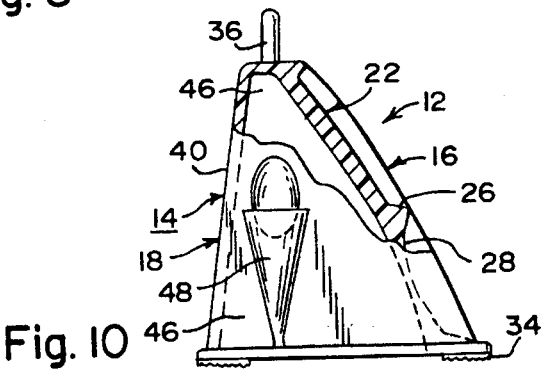
FIG. 10 is an enlarged side view taken in the direction of arrow 10 in FIG. 9 with parts broken away.

In FIGS. 9 and 10, the front panel 16 and the rear panel 18 of the framework 14 are integral structures and have a pair of interconnecting side walls 46. A pair of spare ball holders 48 are provided. Each spare ball holder 48 is located on one side wall 46 of the framework 14.

Figure 7:
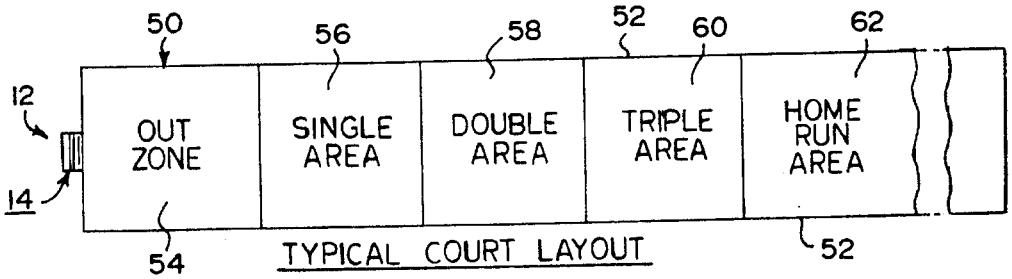
FIG. 7 is a diagrammatic top view of a typical court layout that might be used with the instant invention.
Figure 8:
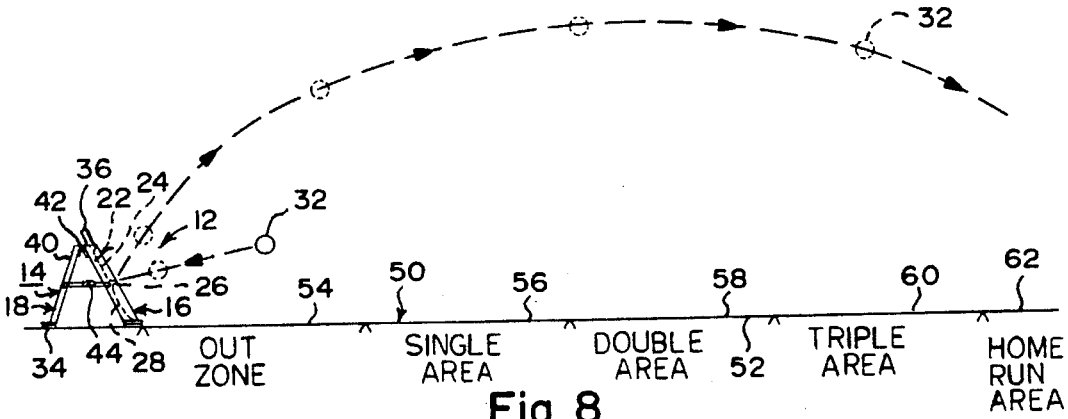
FIG. 8 is a diagrammatic side view taken in the direction of arrow 8 in FIG. 7, showing how the ball rebounds off of the center edge.

A typical playing field, as shown in FIGS. 7 and 8, can include a court 50 thereon having opposite side foul lines 52. The court 50 may divided into a plurality of paying areas 54 to 62, which extend away from the front panel 16 and are labeled "OUT ZONE", "SINGLE AREA", "DOUBLE AREA", "TRIPLE AREA" and "HOME RUN AREA", so as to receive the ball 32 when the ball is rebounded from the striking face 22 of the front panel 16.

OPERATION OF THE INVENTION

Typical rules of a game played with the stoop ball striker 12, which have a number of similarities with baseball are as follows:

1. Any number of players 30 can play the game;
2. The ball 32 is thrown at the striking face 22;
3. The rebounding ball 32 has to stay in bounds;

4. If the ball 32 bounces outside of the foul lines 52 it is an automatic out;

5. All other outs are made by the opposing players 30 catching the ball 32 on the fly;

6. Each player 30 or team gets three outs;

7. Games can be played using a team or having each player 30 rotate on the court 50 and keep their own individual scores on the scoreboard 38;

8. The highest score wins;

9. Usual length of a game is nine innings.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

The invention claimed is:

1. A portable stoop ball striker comprising:

a) a generally A-shaped framework having a rearward tilted front panel and a forward tilted rear panel, whereby said framework can sit upon a horizontal playing field; and b) said front panel having striking face divided into a flat slopped upper surface, a horizontal edge and a curved lower surface, whereby a person can throw a ball against said striking face to rebound the ball at different angles and speeds into said playing field, depending on the skill and strength of the person throwing the ball.

2. A portable stoop ball striker as recited in claim 1, further including rubber foot pads secured to bottom edges of said front panel and said rear panel, so as to prevent said framework from sliding upon the horizontal playing field when the ball rebounds off of said striking face.

3. A portable stoop ball striker as recited in claim 2, including a handle on a top edge of said framework, so that the person can carry said framework by said handle.

4. A portable stoop ball striker as recited in claim 3, further including a score board on an outer surface of said rear panel, so that each player can keep score on said score board.

5. A portable stoop ball striker as recited in claim 4, further including:

a) said front panel and said rear panel of said framework are separate cooperating parts;

b) a hinge rotatively securing the top edges of said front panel and said rear panel; and c) a pair of spreaders, each of which extends generally between central side edges of said front panel and said rear panel, so that said framework can be folded up with said front panel against said rear panel for easy carrying by said handle and for better storage when not erected for use.

6. A portable stoop ball striker as recited in claim 4, further including:

a) said front panel and said rear panel of said framework are formed in an integral structures, with a pair of interconnecting side walls; and b) a pair of spare ball holders, whereby each said spare ball holder is located on one said side wall of said framework.

7. A portable stoop ball striker as recited in claim 1, wherein said playing field can include a court thereon having opposite side foul lines, said court divided into a plurality of paying areas, which extend away from said front panel and are labeled "OUT ZONE", "SINGLE AREA", "DOUBLE AREA", "TRIPLE AREA" and "HOME RUN AREA", so as to receive the ball when the ball is rebounded from said striking face of said front panel.

* * * * *